United States Patent [19]

Tsuzurahara et al.

[11] Patent Number: 4,485,330

[45] Date of Patent: Nov. 27, 1984

[54] MAGNETRON

[75] Inventors: Mamoru Tsuzurahara; Ichiro Inamura, both of Mobara, Japan

[73] Assignee: Hitachi, Ltd., Tokyo, Japan

[21] Appl. No.: 402,737

[22] Filed: Jul. 28, 1982

[30] Foreign Application Priority Data

Aug. 3, 1981 [JP] Japan ..... 56-120756

[51] Int. Cl.[3] ..... H01J 25/50

[52] U.S. Cl. ..... 315/39.51; 313/311; 313/46; 315/39.75; 315/39.77

[58] Field of Search ..... 315/39.51, 39.75, 39.77; 313/311, 46, 47

[56] References Cited

U.S. PATENT DOCUMENTS

| | | | |
|---|---|---|---|
| 2,493,661 | 1/1950 | Espersen | 315/39.75 X |
| 2,810,094 | 10/1957 | Derby et al. | 315/39.51 X |
| 2,852,720 | 9/1958 | Crapuchettes | 315/39.75 |
| 3,412,285 | 11/1968 | Gerard | 315/39.77 X |
| 4,163,175 | 7/1979 | Tashiro | 315/39.51 |
| 4,223,246 | 9/1980 | Osepchuk | 315/39.51 |

*Primary Examiner*—Saxfield Chatmon

*Attorney, Agent, or Firm*—Charles E. Pfund

[57] ABSTRACT

A magnetron comprises an anode cylinder, an even number of vanes radially extending from the inner wall of said anode cylinder and forming together with the anode cylinder a resonant circuit, and sealing members hermetically sealed to the opposite ends of said anode cylinder via seal flanges and respectively connected to a microwave power output section and to a cathode support stem. The anode cylinder and vanes are made of aluminum or an aluminum alloy, the sealing members are made from iron plates, the seal flanges are aluminum-clad iron plates, the sealing members are welded to the seal flanges, and the seal flanges are soldered by aluminum solder to the opposite ends of the anode cylinder.

3 Claims, 1 Drawing Figure

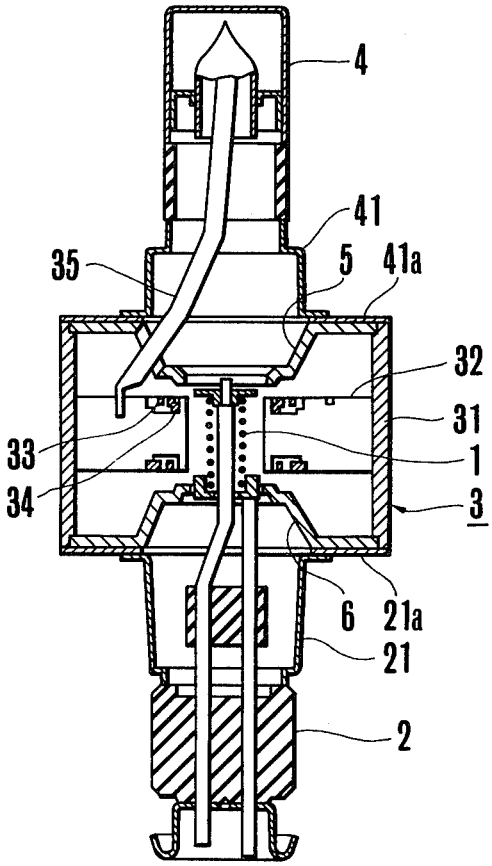
4
41
35
5
41a
32
31
33
1
34
3
6
21a
21
2

MAGNETRON

BACKGROUND OF THE INVENTION

This invention relates to a magnetron which can reduce cost by using aluminum or an aluminum alloy as a material of the anode cylinder and vanes of the magnetron.

In the prior art magnetron, copper is used for the anode cylinder and vanes. The amount of copper used, however, amounts to a considerable quantity, and this is one of the problems encountered when it is intended to reduce the cost of the magnetron.

SUMMARY OF THE INVENTION

An object of the invention is to provide a novel magnetron which uses a more inexpensive material than copper for the anode cylinder and vanes and nevertheless has reliability comparable to that of the prior art magnetron.

According to the invention, aluminum or an aluminum alloy is used for the anode cylinder and vanes, while sealing members which seal the opposite axial ends of the anode cylinder and are respectively connected to a microwave power output section and a cathode support stem are made from iron plates as in the prior art. Seal flanges, which intervene and provide hermetical seal between the opposite ends of the anode cylinder and the corresponding sealing members, are made from aluminum-clad iron plates. These seal flanges are brazed with a solder adaptable for aluminum to the anode cylinder ends while they are welded to the sealing members.

In the technique of joining parts which has long been used in the manufacture of magnetrons, seal flanges made of iron plates are arc welded to the opposite ends of a copper anode cylinder while copper parts are brazed to each other by silver solder or the like. Arc welding, however, cannot be employed to join aluminum or an aluminum alloy to iron. This is because the two metals have greatly different melting temperatures, and brittle and hard intermetallic compounds such as $Al_3Fe$ results when the two are heated together to high temperatures. For this reason, the seal flanges which are made of iron plates cannot be arc welded to the aluminum or aluminum alloy anode cylinder. To solve this problem, according to the invention the seal flanges are made from aluminum-clad iron plates. An aluminum layer that is formed on an iron plate is joined to the anode cylinder made of aluminum or an aluminum alloy by the well-established joining technique using a solder adaptable for aluminum at a low temperature sufficient to avoid formation of $Al_3Fe$. As for the clad plate, the core iron plate may have the opposite sides covered by layers of different materials and/or of different thicknesses. For example, one side may be covered with a relatively thick aluminum layer for soldering with the solder adaptable for aluminum, while the other side may be covered with a relatively thin nickel layer for the sole purpose of preventing rusting. The sealing member which is made from a nickel-plated iron plate may be readily and reliably welded (by electric resistance welding) to the nickel plated side of the aluminum-clad iron plate. The high temperature at the time of the welding may cause formation of $Al_3Fe$ on the aluminum layer side. However, this gives rise to no problem in the mechanical strength since the aluminum layer is provided on the side of the core metal plate opposite the weld (i.e., the evacuated side) and only a portion of the core iron plate that is in contact with the aluminum layer is reacted for conversion to $Al_3Fe$. This $Al_3Fe$ constitutes a blackened surface layer of an aluminum-clad iron plate anode in a receiving tube used in the past and gives rise to no problem in the vacuum technology.

BRIEF DESCRIPTION OF THE DRAWING

A single FIGURE is a longitudinal sectional view, taken along the tube axis, showing a magnetron embodying the invention.

DESCRIPTION OF PREFERRED EMBODIMENT

Referring to the FIGURE, one embodiment of the invention will be described. As shown, a thermionic emission electrode 1, which usually has a thorium tungsten wire coil and lead conductors, is embedded in a cathode stem 2 made of a ceramic material. An anode 3 coaxially surrounds the cathode 1. The anode 3 includes an anode cylinder 31 and an even number of vanes 32 radially extending from the inner wall of the anode cylinder 31 toward the cathode 1. In the prior art magnetron, the anode has been made of copper. According to the invention, it is made of aluminum or an aluminum alloy. Alternate vanes 32 are connected to one another by strap rings 33 and 34.

An antenna 35 is connected at one end to one of the vanes. The other end of the antenna 35 is located in an output section 4, from which microwave power is taken out. This other end of antenna is formed by cutting the antenna 35 wire together with an evacuating tube made of copper or the like in an evacuated and hermetically sealed state using a sealing cutter which is operated with pressurized oil. The inner surface of the evacuating tube, which is made of a comparatively soft metal, and the outer surface of the antenna wire, are cleaned in a pretreatment prior to the evacuation and in the evacuating operation. These clean exposed metal surfaces are urged against each other when the evacuating tube and antenna wire are severed by the sealing cutter. These urged surfaces are thus jointed and made integral; that is, the evacuating tube and antenna wire are electrically connected to each other when they are cut under the evacuated and hermetically sealed condition.

Numerals 5 and 6 designate pole pieces, which serve to concentrate a magnetic flux produced by a permanent magnet, not shown, and efficiently form an axial magnetic field in an interaction space defined between the outer periphery of the cathode 1 and the corresponding ends of the vanes 32. These pole pieces are fitted in the opposite ends of the anode cylinder 31 in the so-called faucet joint fashion.

Numerals 21 and 41 designate sealing members which are made from iron plates plated with nickel for prevention of rusting. They are butt jointed at their one end to the metallized surface of the corresponding ceramic members (one of which is the stem 2) by means of brazing as is well known in the art. At the other end, they are welded to corresponding aluminum-clad iron plates 21*a* and 41*a* on the nickel layer side thereof (opposite the aluminum layer). Flanges 21*a* and 41*a* are soldered, on their aluminum layer side, by aluminum solder to the corresponding ends of the anode cylinder 31, thus sealing the anode cylinder 31 and also securing the pole pieces 5 and 6 fitted therein. (In the case of a copper anode cylinder, iron seal flanges are secured thereto by arc welding.) The solder adaptable for aluminum is suitably a Si-Al alloy. When soldering the flanges 21*a* and 41*a*, the strap rings 33 and 34 may be soldered to the vanes 32 concurrently. In this case, only a single heating step is necessary, and the time required for the manufacture can be reduced.

Although in the foregoing embodiment the iron core of the aluminum-clad iron plates 21*a*, 41*a* are formed with nickel and aluminum layers, the formation of side layers may be realized in various manners for practical purpose since nickel has good wetability to aluminum anode cylinder. For example, the position of nickel and aluminum layers may be reversed; both the layers may be of nickel; both the layers may be of aluminum; and one of the layers of nickel or aluminum may be omitted.

As has been described in the foregoing, with aluminum or an aluminum alloy used for the anode of a magnetron according to the invention, it is possible to reduce the material cost and simplify the manufacturing process so that great reduction of the manufacturing cost can be attained without any sacrifice in the reliability of the product.

What is claimed is:

1. A magnetron comprising an anode cylinder, an even number of vanes radially extending from the inner wall of said anode cylinder and forming together with the anode cylinder a resonant circuit, and sealing members hermetically sealed to the opposite ends of said anode cylinder via seal flanges and respectively connected to a microwave power output section and to a cathode support stem, characterized by said anode cylinder and vanes being made of aluminum, said sealing members being made from iron plates, said seal flanges being aluminum-clad iron plates, said sealing members being welded to said seal flanges, said seal flanges being soldered by aluminum solder to the opposite ends of said anode cylinder.

2. A magnetron comprising an anode cylinder, an even number of vanes radially extending from the inner wall of said anode cylinder and forming together with the anode cylinder a resonant circuit, and sealing members hermetically sealed to the opposite ends of said anode cylinder via seal flanges and respectively connected to a microwave power output section and to a cathode support stem, characterized by said anode cylinder and vanes being made of an aluminum alloy, said sealing members being made from iron plates, said seal flanges being aluminum-clad iron plates, said sealing members being welded to said seal flanges, said seal flanges being soldered by aluminum solder to the opposite ends of said anode cylinder.

3. A magnetron according to claim 1 or 2 wherein said aluminum-clad iron plate has an iron core, and aluminum and nickel layers formed on opposite sides of the iron core, the aluminum side soldered to said anode cylinder and the nickel side welded to said sealing members.

* * * * *